United States Patent [19]

Castoldi, Jr.

[11] 4,051,993

[45] Oct. 4, 1977

[54] POPCORN PACKAGE FOR TWO USERS

[75] Inventor: Alex J. Castoldi, Jr., West Newton, Mass.

[73] Assignee: International Recreational Industries, Inc., Boston, Mass.

[21] Appl. No.: 715,622

[22] Filed: Aug. 18, 1976

[51] Int. Cl.[2] ..... B65D 5/72; B65D 5/10

[52] U.S. Cl. ..... 229/22; 206/604; 206/625

[58] Field of Search ..... 206/498, 45.19; 229/22, 229/51 D, 17 R, 7 R

[56] References Cited

U.S. PATENT DOCUMENTS

| | | | |
|---|---|---|---|
| 1,875,044 | 8/1932 | Leiper | 229/22 |
| 1,933,741 | 11/1933 | Liebetruth | 206/45.19 UX |
| 2,227,741 | 12/1940 | Greenwood | 229/22 |
| 2,754,047 | 7/1956 | Schmidt et al. | 229/51 D |
| 2,935,192 | 5/1960 | Million-Czarnecki | 229/22 X |
| 3,637,130 | 1/1972 | Farquhar | 206/498 X |
| 3,921,804 | 11/1975 | Tester | 206/498 X |

*Primary Examiner*—Davis T. Moorhead

*Attorney, Agent, or Firm*—D. Paul Weaver

[57] ABSTRACT

A package for popcorn or other similar food product is elongated to span the laps of two adjacent theatre viewers seated in theatre seats. The package has a flat bottom for stability and a pair of separated top openings near its opposite ends enabling each user to withdraw popcorn independently of the other user.

3 Claims, 5 Drawing Figures

FIG.1
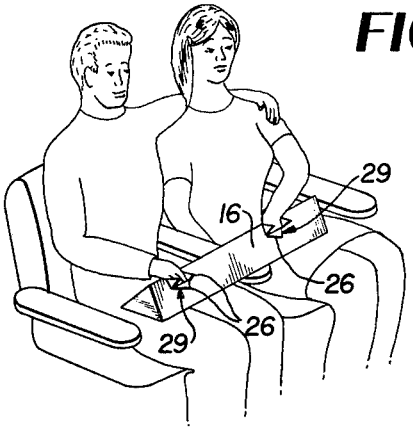
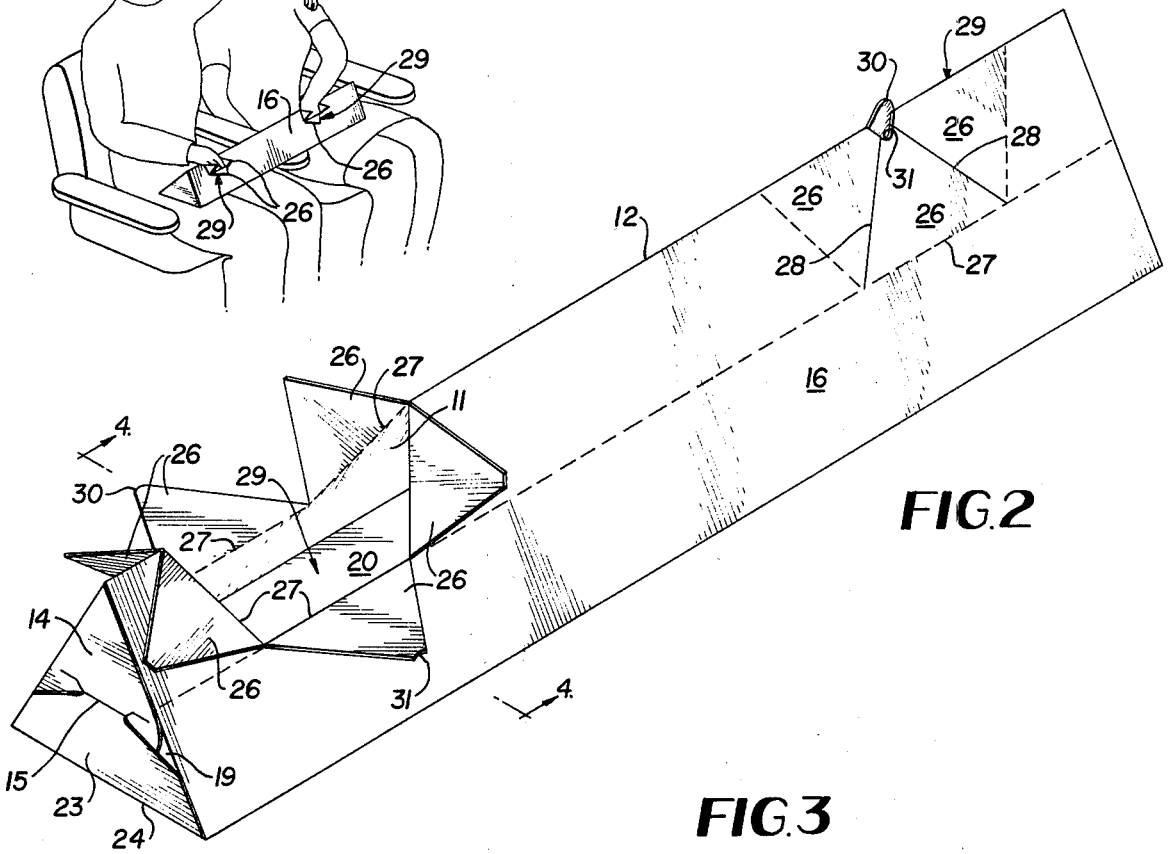
FIG.2
FIG.3
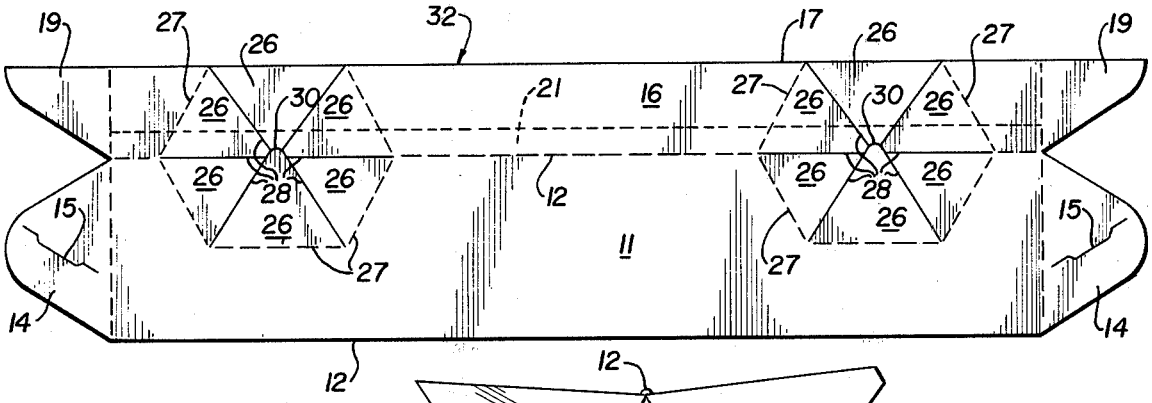
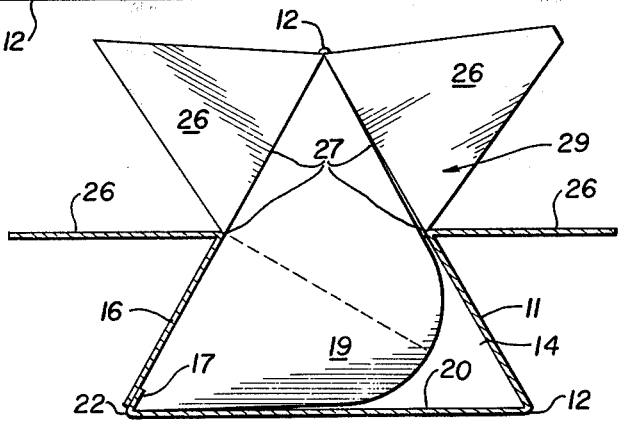
FIG.4

POPCORN PACKAGE FOR TWO USERS

BACKGROUND OF THE INVENTION

Theatre-goers customarily must purchase separate boxes of popcorn or share a single box in a rather awkward and inconvenient manner which necessitates constantly passing the box back and forth between seats or reaching across the companion to take popcorn from the top of the box, when desired. Spillage of popcorn frequently occurs and the operation is somewhat inconvenient.

The objective of this invention is to overcome the above inconvenience by providing a package for popcorn or other loose comestibles which may be shared by two in a theatre or the like, with convenience and without spillage of the product. The arrangement is also more sanitary as each individual user has his or her individual popcorn outlet opening near one end of the package through which the hand of that user may be placed without touching the outlet of the companion user.

Another advantage of the invention is that one party may withdraw popcorn from the package independently of the companion party and without disturbing the companion.

The invention is also characterized by simplicity, economy of manufacture and sturdiness, whereby the package will withstand rather rough handling without collapsing or disintegrating.

Other features and advantages of the invention will become apparent during the course of the following description.

BRIEF DESCRIPTION OF THE DRAWING FIGURES

FIG. 1 is a perspective view of the invention depicting its use by theatre patrons.

FIG. 2 is an enlarged perspective view of the popcorn box or package embodying the invention.

FIG. 3 is a plan view of the package prior to erecting and filling with popcorn and closing.

FIG. 4 is a transverse vertical section through the package at one outlet opening.

DETAILED DESCRIPTION

Figure 5:
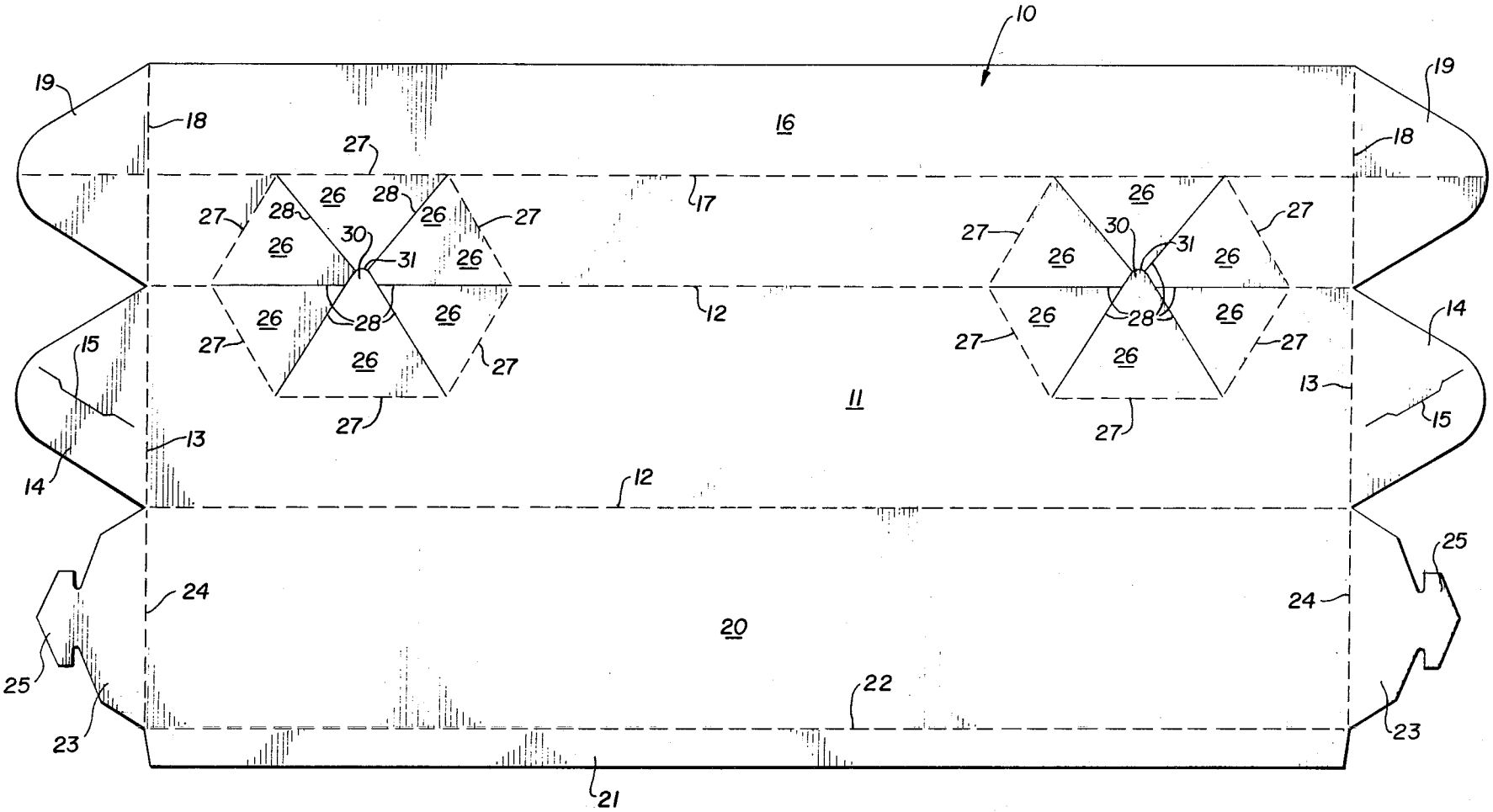
FIG. 5 is a plan view of the initially flat blank from which the package is constructed.

Referring to the drawings in detail, wherein like numerals designate like parts, and referring initially to FIG. 5, a generally rectangular somewhat elongated flat blank 10 of cardboard or the like has a center elongated rectangular panel 11 bounded by parallel side and end folding lines 12 and 13. Roughly triangular foldable end flaps 14 having diagonal tab locking slits 15 are provided on the ends of the center panel 11. A side rectangular panel 16 of the same dimensions as the panel 11 is provided and hinged to the panel 11 on the folding line 12. The panel 16 has a center longitudinal folding line 17 and end folding lines 18 aligned with the folding lines 13. Roughly triangular closure flaps 19 are hinged to the opposite ends of the side panel 16.

An opposite side panel 20 of the same dimensions as the panels 11 and 16 is provided and hinged to the center panel 11 on the folding line 12 and has an integral longitudinal narrow rectangular flap 21 at its free side foldable on a longitudinal folding line 22, parallel to the folding lines 12 and 17. The side panel 20 carries hinged end flaps 23 on end folding lines 24 and these end flaps carry tapered and winged tabs 25 adapted to fit through and interlock with the slits 15 when the blank is folded and erected into package form.

Near their opposite ends, the panels 11 and 16 share two groups of substantially triangular flaps 26 whose faces are hinged to the blank on folding lines 27 in an approximately hexagonal array of folding lines. The flaps 26 are further defined by converging score lines 28 which are readily separable during the use of the package to form a product outlet or mouth 29 as clearly indicated in FIG. 2 and in FIG. 4. One of the flaps 26 has a convenient pull tab 30 at its apex end to facilitate opening each outlet or mouth 29 of the package. The opposing flap 26 in the blank has its apex end notched as at 31.

The originally flat blank 10 is folded on the folding line 12 nearest the longitudinal flap 21 and on the line 17 with the flap 21 being cemented to the interior of the panel 16, as best shown in FIGS. 3 and 4. This produces an elongated flattened tubular package body 32 as depicted in FIG. 3 with the opposite ends open. This is the form in which the package is furnished the theatres and other retailers of suitable comestibles, like popcorn, to be sold in the package of the invention. At this time, the triangular mouth-forming flaps 26 are still joined on the score lines 28.

In order to erect and complete the package so that it may be filled with popcorn or other like product, the retailer simply squeezes the flattened tubular body 32 laterally by hand and the package body will readily fold on the folding line 12 which intersects the two groups of mouth-forming flaps 26 and will also fold on the second fold line 12 and on the line 22. Previously folded line 17 in FIG. 3 will unfold or straighten out so that the package can assume the triangular cross sectional shape shown in the drawings.

One end of the package is now closed by first folding over the flap 19, followed by the flap 14, and then the flap 23, followed by insertion of the locking tab 25 in the slit 15. The popcorn or other product is now placed in the package through its other open end and such end is then closed in the manner just described. When the package is filled with popcorn and has its two ends closed and locked as described, it will be firm and quite rigid. Having the shape of an equilateral triangle in cross section and having a flat base formed by the panel 20, the package will be stable when on the laps of two users, such as two theatre-goers, as depicted in FIG. 1. The package is long enough to span the distance between two users seated in adjacent theatre seats with the package access openings 29 approximately centered relative to the users for convenience. In practice, the erected package is opproximately 2 feet in length with a triangle base width of about 4½ inches.

Each user gains access to the package contents by simply pulling the tab 30 on one flap 26, causing that flap to separate along its score lines 28 from the adjacent flaps. The other triangular flaps 26 can now be separated readily along the remaining score lines 28 to open the package as indicated in FIG. 2 and FIG. 1. The closure flaps 26 can be refolded to the closed position during use if desired for sanitary purposes and to keep the product fresh. The two users or consumers of the product can act independently of one another using their personalized package access openings 29. No transverse divider wall is contemplated for the elongated package although this feature could be added, if desired, to assure equal division of the package contents.

It is believed that the construction, purpose and mode of use of the package will now be readily understood by those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A package for a comestible allowing two theatre patrons seated side-by-side in two theatre seats to consume the comestible in said package conveniently, said package comprising an elongated continuous undivided package body having a single continuous comestible chamber, said package body having a flat bottom wall for stability when the package is resting on the laps of two users, the package body having a sufficient length to extend approximately between the centers of two adjacent theatre seats, and means forming a pair of separated top product access and removal openings in the package body near opposite ends thereof, the package body and said comestible chamber being otherwise closed.

2. A package for comestibles as defined in claim 1, and said package body being triangular in cross section and said flat bottom wall constituting the base of the triangular package during use thereof.

3. A package for comestibles as defined in claim 2 and said means forming said pair of openings comprising plural roughly triangular hinged closure flaps on the opposite side walls of the triangular cross section package body.

* * * * *